United States Patent [19]

Drori

[11] 4,146,003

[45] Mar. 27, 1979

[54] FUEL INJECTION PUMPING APPARATUS WITH DRAIN PASSAGE

[75] Inventor: Moshe Drori, East Twickenham, England

[73] Assignee: Lucas Industries Limited, Birmingham, England

[21] Appl. No.: 809,681

[22] Filed: Jun. 24, 1977

[30] Foreign Application Priority Data

Jun. 26, 1976 [GB] United Kingdom ..... 26706/76

[51] Int. Cl.[2] ..... F02M 39/02; F02D 1/06; F04B 29/00

[52] U.S. Cl. ..... 123/139 AL; 123/139 AM; 123/140 A; 417/462

[58] Field of Search ..... 123/139 AL, 139 AF, 123/139 AM, 139 BC, 140 A; 417/462, 558, 251, 252, 253

[56] References Cited

U.S. PATENT DOCUMENTS

| | | | |
|---|---|---|---|
| 2,922,370 | 1/1960 | Bischoff | 417/462 |
| 3,489,093 | 1/1970 | Thornber | 123/139 AL |
| 3,498,226 | 3/1970 | Mowbray | 417/253 |
| 3,811,799 | 5/1974 | Jackson | 417/462 |
| 3,918,853 | 11/1975 | Drori | 417/558 |
| 3,936,244 | 2/1976 | Drori | 417/462 |
| 4,062,336 | 12/1977 | Grant et al. | 123/139 AF |

FOREIGN PATENT DOCUMENTS

| | | | |
|---|---|---|---|
| 1232973 | 5/1971 | United Kingdom | 123/139 AM |

*Primary Examiner*—Charles J. Myhre
*Assistant Examiner*—P. S. Lall

[57] ABSTRACT

A fuel injection pumping apparatus includes an injection pump and a delivery valve through which fuel flows from the injection pump to an outlet, the apparatus includes a spill passage and a valve for controlling flow through the passage. The position of the valve is determined by the speed of the associated engine and above a predetermined speed flow can occur through the passage so that no fuel flows past the delivery valve. The valve also enables when the engine speed is below a second predetermined value lower than the first predetermined value, flow to take place through the passage.

6 Claims, 4 Drawing Figures

FUEL INJECTION PUMPING APPARATUS WITH DRAIN PASSAGE

This invention relates to a liquid fuel injection pump supplying fuel to an internal combustion engine and of the kind comprising a body part, a rotary distributor in the body part, a transverse bore in the distributor, a pump plunger in said bore, cam means for imparting inward movement to the plunger as the distributor rotates, thereby to expel fuel from said bore, a delivery passage in communication with said bore and extending to the periphery of the distributor to register in turn with outlets in the body part during the time the plunger is moved inwardly by the cam means, said outlets in use communicating with injection nozzles respectively, a spring loaded delivery valve in said delivery passage, said delivery valve being opened by the flow of fuel from the bore and when the flow of fuel ceases said valve allowing a predetermined volume of fuel to return to said bore before it closes and throttle means through which fuel can flow to said bore during the time the plunger is allowed to moved outwardly by said cam means.

Such pumps are well known and the purpose of the delivery valve is to maintain a pressure in the pipeline connected to the nozzle, between injection periods. An unloading delivery valve is preferred because this allows a predetermined flow of fuel from the pipeline at the end of an injection period thereby lowering the pressure in the pipeline to a predetermined value and allowing a control valve in the injection nozzle to close quickly. A single delivery valve is particularly useful where the pump is to provide fuel to a number of engine cylinders in turn. The provision of a delivery valve does however pose a problem and an unloading delivery valve poses a second problem. The first problem is the venting of air from the bore and the portion of the delivery passage downstream of the valve. If air is trapped it can prevent sufficient pressure being generated to lift the delivery valve against its spring pressure with the result that there will be no pumping action. The second problem occurs under high-speed over-run conditions when the throttle means is closed so that the only volume of fuel which is being pumped by the plunger is the small volume which was unloaded by the delivery valve before it closed. The effect of this small volume of fuel is to impose severe stresses on the delivery valve spring which can result in premature failure of the spring.

The object of the invention is to provide a pump of the kind specified in a form in which the two problems outlined above are overcome.

According to the invention a pump of the kind specified comprises a drain passage extending to the periphery of the distributor, said drain passage communicating with said delivery passage downstream of said delivery valve, a drain port formed in the body for registration with said drain passage once per revolution of the distributor and during inward movement of the plunger, and valve means in the body for controlling flow through said drain port.

One example of a pump in accordance with the invention will now be described with reference to the accompanying drawings in which.

Figure 1:
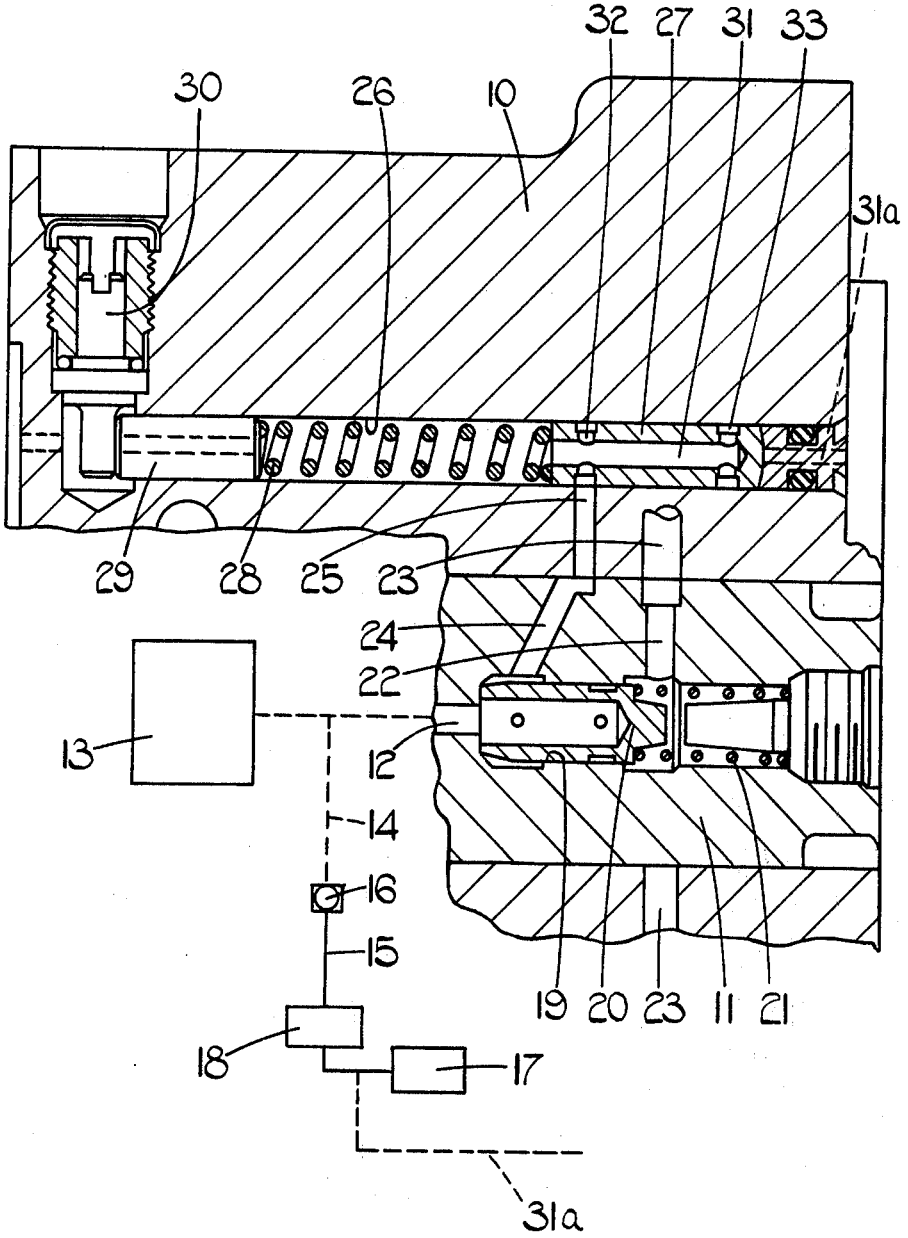
FIG. 1 is a part sectional view of a pump.

Referring to FIG. 1 of the drawings, the pump comprises a body part 10 in which is journalled a rotary cylindrical distributor member 11. Formed in the distributor member is a delivery passage 12 which extends in a well known manner, from a transverse bore which accommodates a pair of reciprocable pumping plungers. Surrounding the distributor member and in alignment with the aforesaid bore, is an annular cam ring having inwardly extending pairs of cam lobes which as the distributor is rotated, effect inward movement of the plungers. The plungers, bore and cam constitute an injection pump which is shown diagrammatically at 13. Part of the passage 12 serves the dual function of conveying fuel away from the bore accommodating the plungers and also conveying fuel to the bore. The fuel flowing to the bore flows by way of an inlet passage 14 which communicates with a fuel supply passage 15 formed in the body 10. The communication of the passages 14 and 15 is by way of a valve means 16. This may take the form of a simple non-return valve which can open to allow fuel supply to the bore containing the pumping plungers or as is well known, it may take the form of a plurality of inlet passages formed in the distributor member which register in turn with the supply passage 15.

The supply passage 15 is in communication with the outlet of a fuel supply pump 17 by way of a throttle means 18. The throttle means 18 is adjustable so that the amount of fuel supplied to the bore containing the plungers can be varied and the throttle means will in fact be controlled by a governor which is responsive to the speed of the associated engine.

The passage 12 is enlarged at its end remote from the injection pump 13 to define a chamber 19 and in which is located an axially slidable delivery valve member 20 which is spring loaded by means of a coiled compression spring 21. The extent of movement of the valve member against the action of the spring is determined by the abutment of stops defined on the valve member and on a plug serving to close the end of the passage 12. Extending from the portion of the chamber containing the spring is an extension of the delivery passage which is referenced 22 and this extends to the periphery of the distributor for registration with a plurality of outlet ports 23 which are formed in the body and which in use, are connected by pipelines to the injection nozzles of the associated engine.

As will be observed the delivery valve member 20 is provided with a blind bore having a pair of transverse drillings communicating therewith. The drilling remote from the injection pump 13 places the bore in communcation with an annular groove in the delivery valve and the arrangement is such that when fuel is supplied by the injection pump the delivery valve is moved against the action of its spring and after a predetermined movement, the aforesaid groove is exposed to the chamber containing the spring so that fuel can flow from the injection pump to the portion 22 of the delivery passage and to an outlet port 23. When the flow of fuel from the injection pump ceases then the delivery valve member is returned to the position in which it is shown by means of the coiled compression spring 21. Such movement allows a predetermined volume of fuel to be displaced back towards the injection pump and reduces the pressure in the pipeline associated with the outlet 23 with which the portion of the passage 22 is in register.

The drilling in the valve member 20 which is nearer to the injection pump 13 communicates with a groove formed in the chamber 19 and this groove communicates with one end of a drain passage 24 the other end of which extends to the periphery of the distributor. Moreover, formed in the body is a drain port 25 and the arrangement is such that the passage 24 and port 25 are brought into register once per revolution of the distributor and during the time when the portion 22 of the delivery passage is in register with an outlet. It will be appreciated that effectively the passage 24 extends from downstream of the delivery valve.

Formed in the body part is a bore 26 which conveniently extends parallel to but spaced from the axis of rotation of the distributor. The drain port 25 extends into the bore 26 and located within the bore is an axially movable valve member 27. The valve member 27 is spring loaded by means of a coiled compression spring 28 and the force exerted by the spring 28 can be adjusted by means of a plug 29 which is engaged by an adjustor 30 operable from the exterior of the body. The valve member 27 is movable against the action of the spring 28 by means of fuel under pressure obtained by way of a passage 31*a*, from the outlet of the supply pump 17 the output pressure of which is arranged in a well known manner, to vary in accordance with the speed at which the apparatus is driven.

Formed in the valve member 27 is a blind bore 31 which is in communication with the portion of the bore 26 containing the spring. In addition, the plug 29 is provided with a through bore which is in communication with a drain space defined in the body, the aforesaid drain space communicating generally with the inlet of the supply pump 17. The passage 31 communicates by way of cross drillings, with a pair of circumferential grooves 32, 33 formed on the valve member 27. The groove 32 is positioned so that when the pump is at rest as is shown in FIG. 1, it will be in register with the drain port 25. The preload of the spring 28 is adjusted so that the valve member remains in this position during cranking of the engine for starting purposes. As a result when the engine is cranked once per revolution fuel displaced by the injection pump together with any air if such is present, can flow along the drain passage 24 through the drain port 25, the groove 32 and the bore 31 to the aforesaid drain space. During such flow no fuel will be delivered to the particular engine cylinder whose respective outlet 23 is in communication with the portion 22 of the delivery passage. The air however will gradually be vented. The engine will therefore start on the remaining cylinders and as the engine speed builds up to idling speed, the outlet pressure of the supply pump 17 will increase to the extent that the valve member 27 is moved against the action of the spring 28 to move the groove 32 out of register with the drain port 25. When this occurs the aforesaid cylinder which was not receiving fuel will now receive fuel and the engine will operate normally.

It is arranged that during the normal operating range of the engine that is to say from idling speed up to the governed maximum speed, the valve member 27 maintains the drain port closed. Under conditions of over-run at high speed that is to say a speed in excess of the governed maximum speed, it is arranged that the valve member 27 moves to place the groove 33 in communication with the drain port 25. It will be appreciated that this over-run condition can occur when the vehicle in which the engine is mounted, is moving downhill and is gathering speed even though the throttle means 18 is closed and no fuel is being supplied to the engine. The fact that the groove 33 is placed in communication with the drain port 25 allows the unloaded volume of fuel which was returned to the injection pump during the last effective pumping stroke, and any fuel entering the distributor member due to seepage, to flow by way of the drain passage 24 and the drain port 25 to the drain. Thus this volume of fuel is no longer effective to cause displacement of the delivery valve member 20. As a result during over-run conditions with the throttle means 18 closed and above the normal governed speed, the delivery valve does not oscillate as would otherwise be the case. The spring 21 of the delivery valve is therefore not subjected to stress during this period.

It will of course be appreciated that over-run conditions can occur at below the maximum governed engine speed. Under these conditions the delivery valve does oscillate but since the speed is lower the stress imposed on the delivery spring 21 is lower.

It will thus be seen that the provision of the valve 27 provides the dual function of venting any air and protecting the delivery valve during high speed over-run conditions.

In some instances it may be undesirable to vent the air to the aforesaid space. This problem can be overcome by providing a vent passage in the body which is aligned with the drain port 25 and which incorporates a removable plug. When it is known that air is present, this plug can be removed and the air is vented through the air passage. When the venting of air has finished the plug can be replaced.

Figure 2:
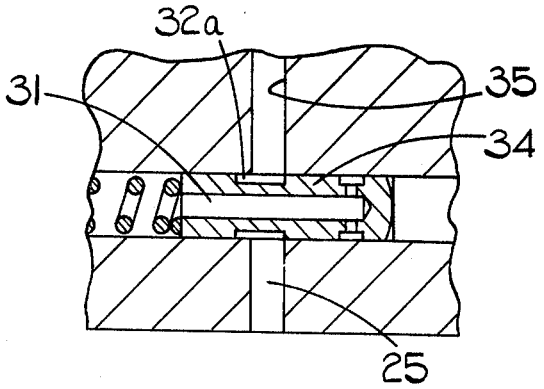
FIGS. 2, 3 and 4 show an alternative construction of valves shown in FIG. 1 and at different settings.
Figure 3:
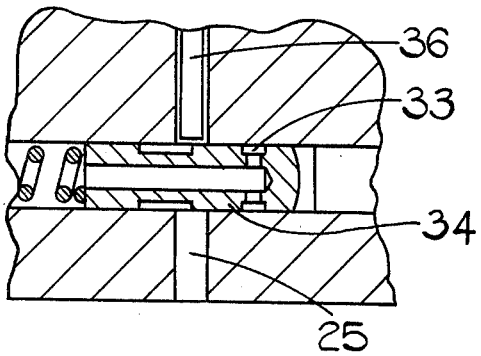
Figure 4:
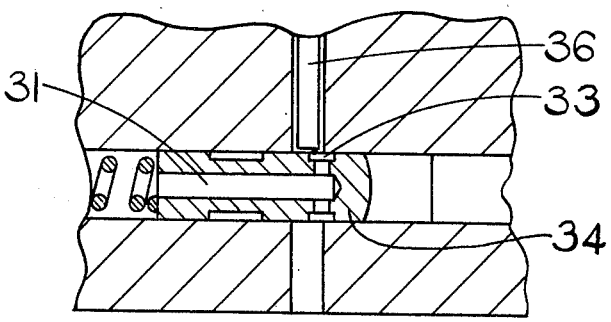

The arrangement shown in FIGS. 2, 3 and 4 incorporates such a plug and the valve member 34 which replaces the valve member 27 is slightly different in that the circumferential groove 32*a* does not communicate with the bore 31. In this case therefore venting of the air can only take place through the vent passage which is indicated at 35. FIG. 2 shows the situation when the plug is removed from the vent passage 35 and venting of the air can take place. When it is known that the air has been removed the plug which is indicated at 36 is replaced and no further venting takes place so that fuel will now flow to the one engine cylinder which was not receiving fuel during the venting process. It will be understood that because the vent passage 35 is closed the position of the valve 34 is not so critical so long as the circumferential groove 34 is not brought into register with the drain portion 25 until the maximum governed engine speed has been exceeded. The normal running situation therefore is shown in FIG. 3 and FIG. 4 shows the situation where the normal governed speed has been exceeded. In this latter position the operation of the valve 34 is exactly the same as the valve 27 shown in FIG. 1.

I claim:

1. A fuel injection pumping apparatus for supplying fuel to an internal combustion engine and comprising a body part having outlets, a rotary distributor in the body part, an injection pump, a delivery passage in communication with said injection pump and extending to the periphery of the distributor to register in turn with outlets in the body part during the time the injection pump supplies fuel to said delivery passage, said outlets in use communicating with injection nozzles respectively, a spring loaded delivery valve in said delivery passage, said delivery valve being opened by the flow of fuel from the injection pump and when the flow of fuel ceases said valve allowing a predetermined volume of fuel to return to said injection pump before it closes, and throttle means through which fuel can flow to said injection pump, a drain passage extending to the periphery of the distributor, said drain passage communicating with said delivery passage downstream of said delivery valve, a drain port formed in the body part for registration with said drain passage once per revolution of the distributor and during flow of fuel to said injection pump, and valve means in the body part for controlling flow through said drain port, said valve means including a valve member slidable within a bore, resilient means biasing the valve member to a first position, conduit means through which the valve member can be subjected to a fluid pressure which varies in accordance with the speed at which the associated engine is driven, said fluid pressure acting to move the valve member against the action of the resilient means to a second position which is attained when the speed of the associated engine has risen to above a predetermined value and passage means in said valve member and which in the second position of said valve member places said drain port in communication with a drain.

2. A pumping apparatus according to claim 1, in which said passage means comprises a circumferential groove on the valve member, and which in the second position of the valve member is in register with said port, and a passage in said valve member which communicates with said groove.

3. A pumping apparatus according to claim 2 including a drain conduit in said body part, a plug mounted in said drain conduit and removable therefrom to permit flow through said drain conduit, and means on the valve member which in the first position of the valve member places said drain conduit in communication with said drain port.

4. A pumping apparatus according to claim 3 in which said means on said valve member comprises a second circumferential groove.

5. A pumping apparatus according to claim 1 including further passage means defined by said valve member and which in the first position of the valve member also places said drain port in communication with a drain.

6. A pumping apparatus according to claim 5 in which said further passage means includes a second groove on said valve member, said second groove communicating with said passage, said valve member moving from said first position towards said second position when the speed of the associated engine has risen to a second predetermined value lower than said first mentioned predetermined value, whereby between said values of engine speed flow of fuel through said drain port will be prevented.

* * * * *